United States Patent [19]

Lecuyer et al.

[11] Patent Number: 4,777,861

[45] Date of Patent: Oct. 18, 1988

[54] MISSILE AIMING SIGHT

[75] Inventors: John G. Lecuyer, Crystal Lake; James P. Smith, McHenry, both of Ill.

[73] Assignee: Recon/Optical, Inc.

[21] Appl. No.: 3,737

[22] Filed: Jan. 16, 1987

[51] Int. Cl.[4] ..... F41F 3/045; F41F 3/042

[52] U.S. Cl. ..... 89/1.813; 89/41.17; 89/28.2

[58] Field of Search ..... 89/41.09, 41.15, 41.17, 89/41.22, 1.701, 1.702, 1.703, 1.704, 1.705, 1.706, 1.818, 28.2, 1.8, 1.807, 1.808, 1.811, 1.813, 1.814, 1.816; 42/103; 244/3.16, 3.17

[56] References Cited

U.S. PATENT DOCUMENTS

| | | | |
|---|---|---|---|
| 1,621,201 | 3/1927 | Henderson | 89/28.2 |
| 2,455,963 | 12/1948 | Wheeler | 89/41.17 |
| 2,464,195 | 3/1949 | Burley et al. | 89/41.17 |
| 3,685,159 | 8/1972 | Erhard | 89/41.22 |
| 4,008,869 | 2/1977 | Weiss | 89/41.22 |
| 4,038,521 | 7/1977 | Baumann | 89/41.22 |

FOREIGN PATENT DOCUMENTS

| | | | |
|---|---|---|---|
| 2143931 | 2/1985 | United Kingdom | 244/3.11 |

*Primary Examiner*—Deborah L. Kyle
*Assistant Examiner*—Stephen Johnson
*Attorney, Agent, or Firm*—Allegretti & Witcoff, Ltd.

[57] ABSTRACT

A missile aiming sight for use in a man-portable missile launching system which includes an adaptor section for connection between a conventional grip-stock and missile launching tube. The aiming sight monitors the electrical communication between the launching tube and grip-stock in order to drive a pair of sighting reticles. The reticles are positioned in the image plane of a telescopic viewing system for providing a visual indication by the intersection of the reticles as to the point of regard of the missile. A separate visual indicator is positioned at the center of the image plane to indicate that the missile electronics has locked on to a target. Additional indication is provided in the image plane to indicate out-of-tolerance and other sighting conditions to alert the operator to restart the missile firing process.

18 Claims, 3 Drawing Sheets

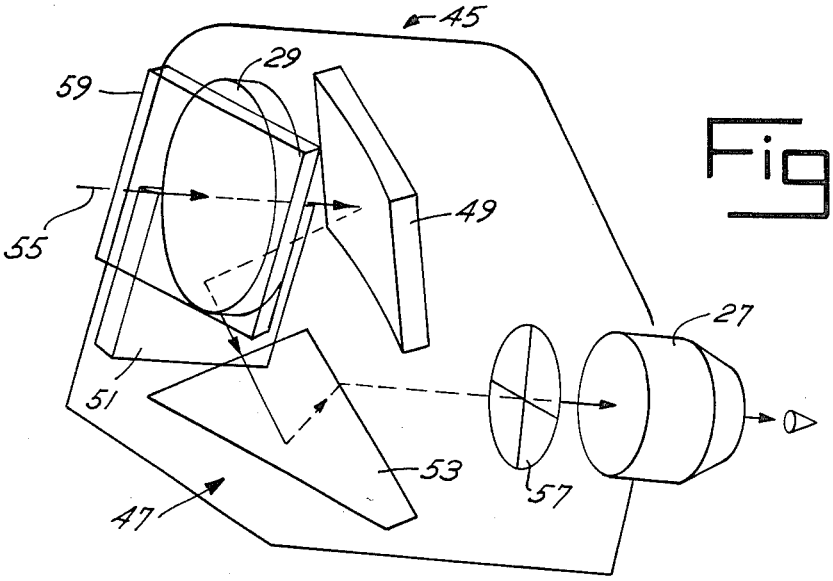
Fig. 3
Fig. 4
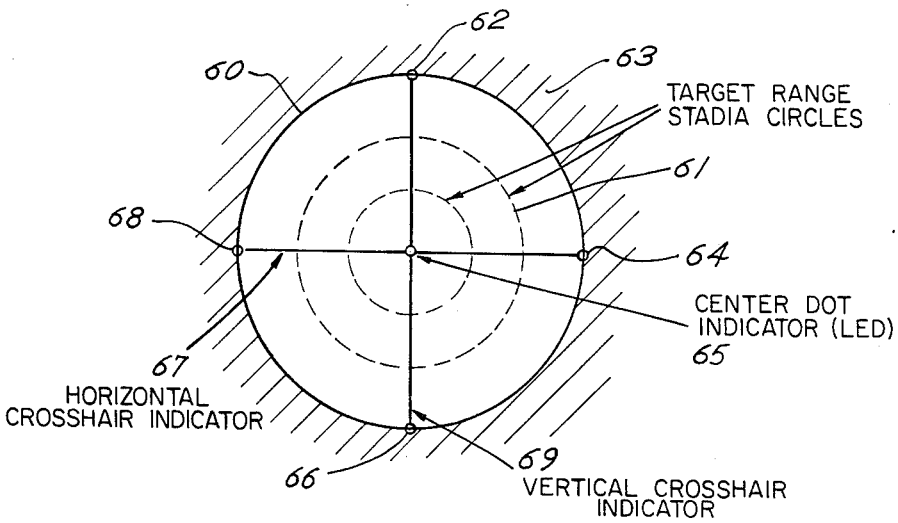
Fig. 6
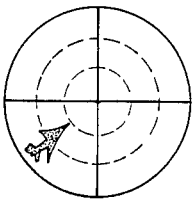
Fig. 7
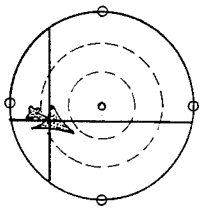
Fig. 8
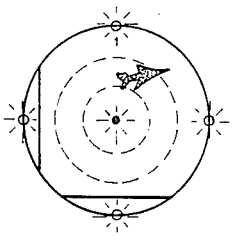

MISSILE ELECTRONICS
GRIP-STOCK
15
27
75
73
1ST
2ND
3RD
39
41
43
77
71
CONDITIONING CIRCUIT
79
RATE SYNTHESIZER
93
82
80
DEMODULATOR
81
95
113
94
83
X
85
Y
99
97
ELEVATION SENSOR
96
91
SUMMING AMP
X
Y
101
LEAD COMPUTER
111
109
FIRE INHIBIT
107
103
105
82
115
84
123
121
BIT
127
LED
65
89
125
129
67
69
87

MISSILE AIMING SIGHT

BACKGROUND OF THE INVENTION

The invention relates to a man-portable air defense missile system, and more particularly to an aiming sight for use in such a missle system.

A conventional man-portable air defense system includes a missle, a missle launching tube and a grip-stock. The grip-stock is connectable to the launching tube to enable the operator to launch a missle from within the tube. After launch, the grip-stock is disconnected and the use launching tube is discarded. The grip-stock is then connected to a new missle launching tube.

The operator uses such a missle system in a shot gun fashion, by positioning the missle tube over one shoulder and directing or pointing the tube upwards toward a stationary or moving target. The missile launching tube includes the missle as well as electronic circuitry for control and guidance of the missle. The missile is of the heat-seeking type which searches for a "hot spot" as a target. When a target is detected, the missile electronics informs the operator by an audible signal from the grip-stock indicating that the missile has locked onto a heat source and that the missile may be launched. The missile is launched by activation of a trigger in the grip-stock.

The use of such a system in battle poses problems of target identification to assure, on the first instance, that the target which the missile is locked onto is the enemy. A second problem involves the operator's understanding of which of the several hot targets in the general aiming direction of the tube has the missile locked on to.

It is therefore an object of the present invention to provide a missile aiming sight which permits a precise identification of a target to be fired upon.

It is yet another object of the present invention to provide a missile aiming sight which is connectable to conventionally manufactured grip-stock and missile launching tube of a man-portable air defense system.

It is a further object of the present invention to provide a missile aiming sight which facilitates "aiming" or "pointing" of the missile at an appropriate position with respect to a moving target.

SUMMARY OF THE INVENTION

These and other objects of the invention are achieved in a missile aiming sight for use in a man-portable missile launching system. The sight includes a telescopic viewing system for magnified viewing of a target to be fired upon. The telescopic viewing system includes an image plane within which is located at least one reticle indicator movable in accordance with the point of regard of the missile tracking head for visually indicating to the operator the target "seen" by the missile.

BRIEF DESCRIPTION OF THE DRAWINGS

FIG. 3 is a perspective view of a diagram representation of the optical system of the aiming sight of FIG. 2.

FIG. 4 is a diagrammatic representation of the reticle system in the field of view of the aiming sight of FIG. 2.

FIGS. 6–8 show various scenes in the field of view of the aiming sight of FIG. 2.

DESCRIPTION OF PREFERRED EMBODIMENT

Figure 1:
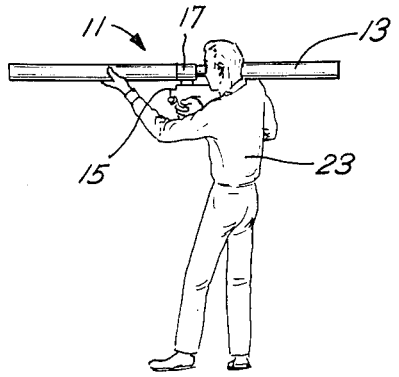
FIG. 1 is a perspective view of a missile launch operator aiming a man-portable missile launching system.
Figure 2:
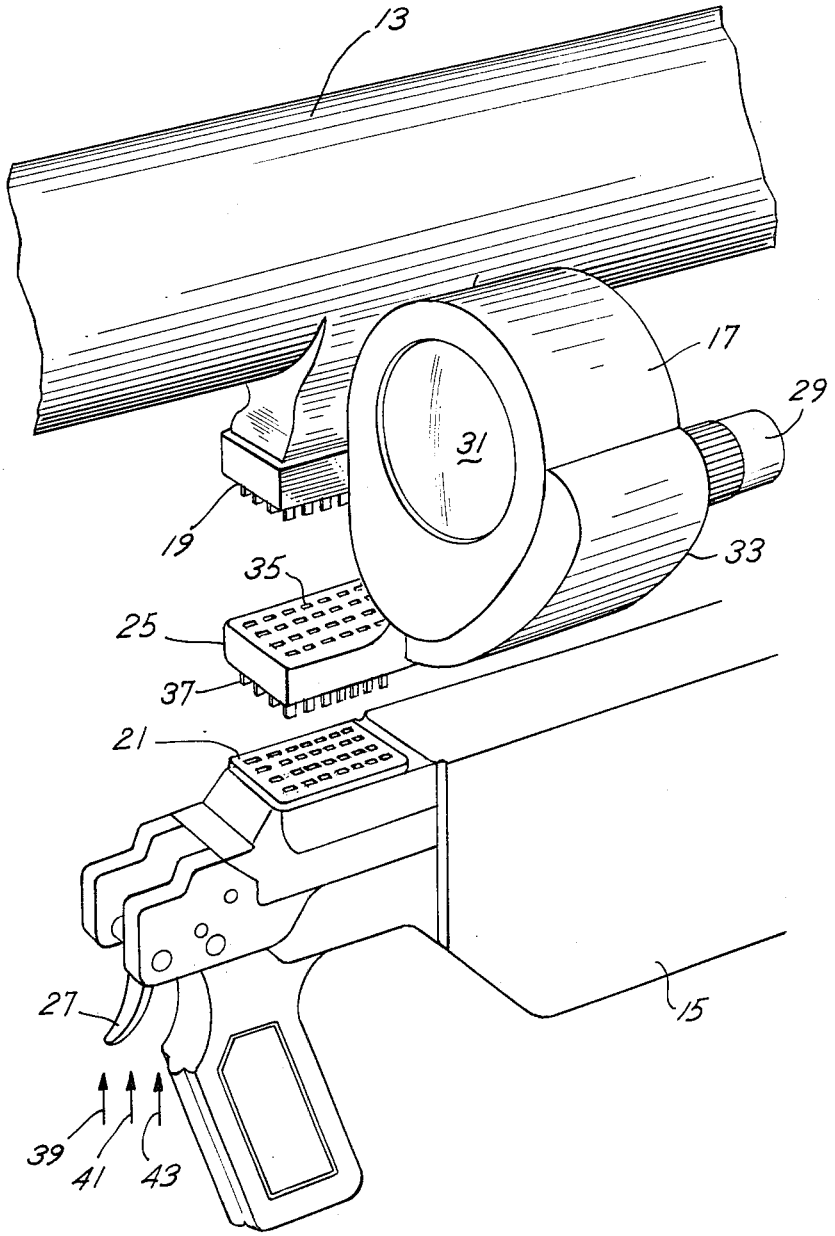
FIG. 2 is a cut away perspective view of a missile launch tube, a grip-stock and an aiming sight of the launching system of FIG. 1.

Referring to FIGS. 1 and 2, a man-portable air defense missile system 11 includes a missile (not shown), a missile launching tube 13, a grip-stock 15 and a missile aiming sight 17. Tube 13 and grip-stock 15 are conventional components manufactured for use without aiming sight 17. Aiming sight 17 is constructed as an interface which is connectable between the grip-stock and tube. In its conventional operation (without sight 17), grip-stock 15 communicates with launch tube 13 in order to fire the missile from tube 13. Aiming sight 17, when interfaced between the grip-stock and tube, monitors the electrical and mechanical communication therebetween without affecting that communication.

As shown in FIG. 2, launch tube 13 is cylindrical in shape and includes a male plug element 19 extending from its outer surface. Element 19 is manufactured in a form to be plug secured directly into a female plug receptacle 21 of grip-stock 15. In ordinary use, a missile launch operator 23 (FIG. 1) connects plug receptacle 21 of the grip-stock into plug element 19 of the tube. The tube is next placed on the operator's shoulder for firing in a shotgun fashion, similar to that shown in FIG. 1.

As shown in FIG. 2, sight 17 includes an adaptor section 25 for connection between grip-stock 15 and launch tube 13. The particular physical form of adaptor section 25 may be of any desired shape or size and may be constructed with the physical shape of the particular missile tube and grip-stock in mind. As understood, the drawing of FIG. 2 is used merely as an aid to this description and does not attempt to show the entire casing structure of any particular launch tube 13 or grip-stock 15.

Grip-stock 15 includes a trigger 27 which is manually actuable by the operator for controlling the missile launch sequence of the system. After launching of the missile, the grip-stock is removed from the tube and the used tube is discarded. The grip-stock is then used with another launching tube.

As shown in FIG. 2, missile aiming sight 17 includes an eyepiece 29 and an objective lens 31 through which the launch operator views a target to be fired upon, as shown generally in FIG. 1. Between eyepiece 29 and objective lens 31 is an image erection system which is described hereinafter in reference to FIG. 3. A casing 33 houses the optical system, and an electronic system (described hereinafter), protecting the same from the environment. The particular configuration of the casing may be of any desired shape.

Adaptor section 25 provides an area for interposing the sight between tube 13 and grip-stock 15. A female receptacle 35 receives plug element 19 of the launch tube and a plug element 37 engages into receptacle 21 of the grip-stock. The grip-stock and launch tube are electrically and mechanically connected through the adaptor section as though the aiming sight was not interposed between the grip-stock and tube. The electrical communications between the grip-stock and the tube are monitored by the aiming sight, as described more fully hereinafter.

As understood, the manner in which the particular grip-stock communicates with the particular launch tube being interfaced may dictate the structure of adaptor section 25. The invention is not limited to a particular grip-stock and launch tube, as will be understood from the claims. The only requirement is that the aiming sight electronics have access to the missile tracking head signals, described hereinafter.

The missile within tube 13 is a heat seeking missile and includes an electronic circuit which controls its launch and guides the missile in response to heat radiation from the target. The electronic circuit includes a missile tracking head formed of a gyro stabilized detector which may be caged or uncaged. In its uncaged state, the detector is free to turn within gimbels and allows the tracking head to track the target. The electronic circuit generates a missile tracking head signal which is an electrical signal representative of the point of regard of the missile, i.e., representative of the relative direction in which the circuit will guide the missile. Such circuits are conventional and understood by a person of ordinary skill in this art.

Trigger 27 is movable by the operator to one of three different positions, generally indicated by reference numerals 39, 41, 43. Trigger 27 is normally biased to a first position 39 in which the system is in a SENSING mode. In the SENSING mode, the gyro stabilized detector remains caged. The detector locates a "hot" target by being pointed in various directions by the operator until the detector locates a source emitting a large quantity of IR rays. When the missile's detector finds a large heat source (commonly referred to as "locking-on" a target), a lock-on signal is generated by the missile's electronic circuit. The lock-on signal is an audio frequency signal which is transmitted to a speaker (not shown) located in the grip-stock. Sound is generated from the speaker to alert the operator that a target has been located and that the trigger may be moved to its second position 41 to uncage the gyro stabilized detector and begin its tracking of the target.

When the operator moves the trigger to the second position 41, the missile is uncaged and the missile's tracking system is activated.

The operator, of course, continues to move the missile tube with his arms, "aiming" or "pointing" the tube at the target. The missile tube has a point of regard which is defined by the axis of the tube. Using the sight 17 the operator is better able to point the axis of the tube with respect to the target.

As understood, there may be a number of heat sources in the air in the general direction at which the operator is "pointing" the tube. The operator may not know which of the specific heat sources that the missile has actually locked onto.

When the operator moves the trigger to the third position 43, the missile is launched from tube 13. As understood, the missile operator should aim the tube ahead of the moving target to assure a more likely chance for a hit. This is true even though the missile has its own heat seeking guidance system.

Referring to FIG. 3, an optical telescopic system 45 is formed of eyepiece 27, an image erection system 47, and an achromatic objective lens 29. Erection system 47 is commonly known as a "second type", having two mirrors 49, 51 and one dual reflection prism 53. Where weight is important, prism 53 may be replaced by mirrors. Any form of image erection may be employed either reflecting or refracting.

Light entering objective lens 29 along a pathway 55 is rotated by erection system 47 forming an image at an image plane 57 located in front of eyepiece 27. A window 59 formed of a plate of glass may be positioned in front of objective lens 29 and serves to protect the objective lens. Also, window 59 is tilted with respect to lens 29 for reducing glint (optical signature) across the lens.

The focus of objective lens 29 is not adjustable, but is fixed to coincide with the intended operational range. Eyepiece 27 is adjustable over a range of $\pm 3$ diopters to accommodate individual user eye characteristics.

Light collected by objective lens 29 is brought to focus at image plane 57. The two mirrors 49, 51 and prism 53 effect a 180° image rotation to erect the image. Thus, the target is magnified to the operator as the operator views through the eyepiece serving to facilitate target identification at extended ranges. The operator may view through the sight for search of targets prior to actuation of the trigger to its second position.

Telescopic system 45 has a viewing area which provides a pre-determined field of view to the operator. This viewing area is focussed at the image plane and a particular view area is provided to the operator at the image plane.

Referring to FIG. 4, the view area 60 which the operator sees in image plane 57 is circular in shape. A plurality of sighthead indicators are located in image plane 57 of the optical system and are seen by the operator as silhouettes against the observed scene. The indicators are both passive and active. The passive indicators comprise a group of stadia circles 61, 63 used to determine target in-range condition. Stadia circles 61, 63 are carried on a thin glass plate located in the image plane 57 for permitting viewing of the circles through eyepiece 13.

A center dot indicator 65 and a plurality of peripheral indicators 62, 64, 66, 68 are also located on the glass plate. The center dot indicator is positioned at the center of view area 60 and the peripheral indicators are positioned on the edge of view area 60 and intrude by a small amount into the field of view. Center and peripheral indicators 62, 64, 66, 68 are formed from light emitting diodes (LED) which when turned ON appear red and when turned OFF appear black. The LED indicators appear black during target acquisition prior to lock-on, but change to red when the missile is locked onto a target. In addition, the LEDs will flash rapidly ON and OFF to indicate an out-of-tolerance condition, as described hereinafter.

The center dot indicator and the peripheral indicators provide a reference to the operator of the point of regard of the launch tube. The operator's viewing axis through indicator 69 is substantially parallel to the axis of the launch tube, but may be offset so as to accommodate missile operational pecularities, if desired.

A pair of pointers 67, 69 serve as active indicators and appear as a horizontal crosshair reticle 67 and a vertical crosshair reticle 69. Pointers 67, 69 are independently driven within the image plane to indicate the missile tracking head point of regard by the intersection point of the two indicators. As understood, a single reticle may be used which is positionable in accordance with the intersection point of the two reticles.

The indicators are positioned as close to the image plane as possible in order to minimize parallax effect to the operator. The crosshair reticles may be carried by separate movable plates of glass. All three plates of glass are located approximately in the image plane. As used hereinafter, the reticles will be said to lie in the image plane which will mean that the reticles are in or are approximately in the image plane.

Figure 5:
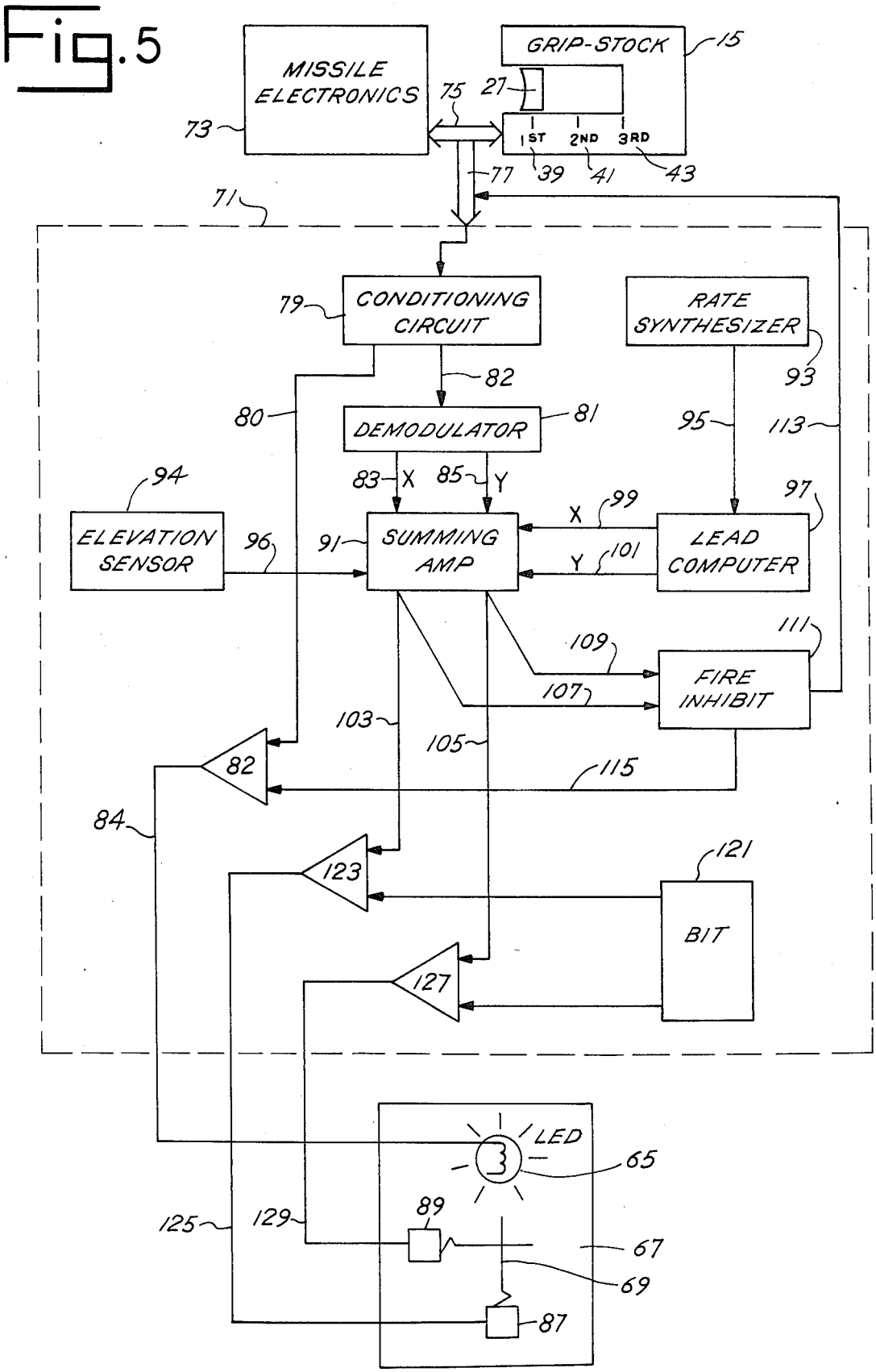
FIG. 5 is a block diagram of the electronic circuit of the lauching system of FIG. 1.

Referring to FIG. 5, an electronic control circuit 71 is housed within the aiming sight and functions to drive crosshair reticles 67, 69 and LED indicator 65. Information communicated between the grip-stock 15 and the missile electronics (shown as block 73 in FIG. 5) is communicated along a bus 77 to control circuit 71. When the missile lock-on signal is generated and supplied to the grip-stock to actuate the sound speaker, control circuit 71 receives the lock-on signal via bus conductor 77. Similarly, when the missile tracking head signal is generated by the missile electronics, the signal is supplied to the grip-stock and is monitored by control circuit 71 via bus conductor 77.

The missile lock-on signal and the missile tracking head signal are normalized by a conditioning circuit 79. Circuit 79 also serves as a buffer to protect the missile from signal loading as well as normalizes the missile signals for use by electronic control circuit 71. Conditioning circuit 79 is constructed in accordance with the particular type of signals which are generated by the missile electronics used by the particular type of missile launch tube 13. The signals are generally analog, but could be digital. The purpose of the conditioning circuit is to scale the received signals from bus 77 into a form for use by electronic circuit 71 in order to drive reticles 67, 69 and LED 65. Conditioning circuit 79 may also filter out unwanted signals.

The normalized missile lock-on signal appears on a conductor 80 for transmission through a gate element 82 and onto a conductor 84 for driving LED 65. The LED is turned ON by the missile lock-on signal indicating target lock-on. A DC voltage signal may be used to turn the LED ON; in which case conditioning circuit 79 converts the lock-on signal to a DC signal of an appropriate magnitude to drive LED 65, when the audio signal is generated by the missile electronics.

The tracking head signal is filtered and scaled by conditioning circuit 79 and appears as an analog signal along a conductor 82. The normalized tracking head signal is received by a demodulator 81 which converts the normalized tracking head signal to an X (abscissa) and Y (ordinate) coordinate analog signals appearing respectively on conductors 83, 85. The demodulator generates the X signal as a DC signal having a sign and magnitude between + or −5 volts. Similarly, the Y signal is generated as a DC signal between + or −5 volts. X and Y signals are eventually fed to a pair of drive galvanometers 87, 89 which drive reticles 69, 67, respectively.

A rate synthesizer 93 measures the rate and angle at which the operator is swinging the missile tube as he tracks a moving target. Rate synthesizer 93 includes a time and disturbance sensing circuit for generating a rate signal along a conductor 95. A lead computer circuit 97 converts the rate signal on conductor 95 to X and Y voltage signals along conductors 99, 101. The signals on conductors 99, 101 are D. C. signals between + and −5 volts.

A summing amplifier circuit 91 algebraically adds the X signals of conductors 83, 99 to produce an X signal along a conductor 103 and adds the Y signals of conductors 85, 101 to produce a Y signal along a conductor 105. The X and Y signals on conductors 103, 105 provide an indication of required missile lead. That is, the missile lead represents the lead in front of the target at which the tube should be pointed ahead of the target to give a more likely chance for successful "hit" or engagement. Thus, lead computer 97 serves to adjust the position of reticles 67, 69 such that the operator's positioning of the tube to place the intersection point of the reticle directly on the target in actuality points the tube ahead of the target.

Control circuit 71 also includes an elevation or horizon sensor 94 that is used to generate a super-elevation signal along a conductor 96 to summing amplifier 91. The super-elevation signal affects the horizontal reticle indicator 67 only. The super-elevation signal is used to elevate the missile tube above what would otherwise be the normal line of sight prior to launch so as to compensate for gravity induced drop. The particular angle of elevation of the tube with respect to the horizon is monitored by sensor 94 for generating the super-elevation signal of a D.C. voltage level having a magnitude dependent on tube elevation.

As will suggest itself, the rate synthesizer, lead computer and elevation sensor need not be used, and the operator will be instructed to aim ahead of and above the moving target for a more likely chance of an engagement. In such a case the X and Y signals from demodulator 91 are fed directly to galvanometers 87, 89.

The X and Y signals on conductors 103, 105 are also fed along conductors 107, 109 to a fire inhibit circuit 111. Fire inhibit circuit 111 uses the X and Y signals on conductors 107, 109 to determine the probability of a successful engagement. Inhibit circuit 111 decides from the X and Y signals whether the dynamic situation exceeds a desired limit or whether the tracking head signals is erratic and random.

The tracking head signal becomes erratic and random if lock-on is lost. Inhibit circuit 111 monitors the X and Y signals for this, and responds by generating an inhibit signal along a conductor 113.

Also, the inhibit circuit serves as a window detector for determining whether the missile point of regard (x position, y position) is beyond the edge of the field of view 60 (FIG. 4) of the sight. The field of view is, of course, a constant (X position, Y position). The missile point of regard is compared against certain X and Y limits to determine whether the tube is pointed correctly to make an engagement. This encourages the operator to keep the viewed target near the center of the field of view as seen through the sight (except as may be directed by lead or super-elevation circuitry discussed above, as understood).

Fire inhibit circuit 97 generates an inhibit signal along a conductor 113 to inhibit the launching of the missile by preventing movement of the trigger 27 to its third position. Trigger 27 includes a mechanical lever arm which cooperates mechanically with launch tube 13 to launch the missile. The lever arm is mechanically coupled through the adaptor section 25 of the sight to perform this function. A solenoid housed in the adaptor section is driven by the inhibit signal on conductor 113 in order to mechanically block the trigger to prevent the trigger from going into its third position.

Fire inhibit circuit 111 also generates a signal along a conductor 115 which passes through a signal switch 82 and onto output drive conductor 84 to LED indicator 65. The fire inhibit signal on conductor 84 has a particular waveform which causes LED 65 to flash rapidly as an out-of-tolerance warning indication to the operator.

A BIT circuit 121 is provided as a test device to assure the operator that the aiming sight is functioning properly. An external test switch (not shown)on the sight may be actuated to run the test. BIT circuit 121 includes a stored program for generating predetermined X signals through a switch 123 and onto a conductor 125 and Y predetermined signals through a switch 127 and onto a conductor 129. The X and Y signals from BIT circuit 121 drives reticels 69, 67 through a repetitive predetermined sequence to reassure the operator that the sight will function correctly during an engagement. Should the reticles not sequence, the operator should replace electronic control circuit 71.

The electronic control circuit 71 is powered by a battery power supply (not shown). The power supply consists of dry cell batteries. A power conditioning circuit accepts the battery supply output, and by means of a conventional DC-to-DC switching converter, produces various power levels required for circuit operation. The power conditioning circuit may include additional circuitry which monitors battery condition and indicates battery status to the operator. Alternatively, the system may be powered by the missile battery system and internal batteries of the sight being used only for the bit system.

To operate the system, the grip-stock, aiming sight and missile tube are connected together by the operator by simply plugging the components into one another. A battery (not shown) is then connected to the missile system to turn it on.

The trigger will be in its first position and the missile electronics will enter its SENSING mode to seek an IR source. The operator will view through the sight as he fans the tube across the sky looking for an appropriate target. When the missile detector locks onto a heat source in the general direction of the point of regard on the missile tube, the operator will hear the audible tone from the grip-stock speaker and will see the LED display light up through the sight. FIG. 6 is an example of what the operator will see through the sight.

If the target is appropriate, the operator will move the trigger to the second position to uncage the gyro stabilized detector. The missile tracking head will enter its TRACKING mode to track the target to which it is locked on. The point of regard signal from the missile tracking head will then drive the reticles, as shown in FIG. 7, to show the operator the specific target on which the missile is locked-on. The target locked on could be different than that perceived by the operator, as shown in FIG. 8.

If the reticles indicate that a different target than what is desired has been locked on, the trigger is released by the operator to move the trigger to its first position to begin the sequence again. If the reticles indicate the correct target is locked on, the operator continues to swing the tube, following the target, and placing the target near the center of the sight for firing (except as the reticles may be displaced by the lead and super-elevation circuits, as understood). With the target near the center of the sight, there is a stronger likelihood of an engagement. The missile is then fired by movement of the trigger to its third position.

What is claimed is:

1. A missile aiming sight for use with a missile launching system having a heat seeking missile with a point of regard, a launch tube having a point of regard along the tube's axis and pointable by an operator with respect to a target an electronic control and guidance system including a tracking means for generating an electrical missile tracking head signal indicative of the missile's point or regard, and a grip-stock including trigger means manually actuable for launching the missile, the missile aiming comprising:

an adapter means connectable to the missile launching system for minitoring the electrical missile tracking head signal generated by the control and electronic guidance system;

a telescopic viewing system for generating a magnified image of a target to be fired upon, the telescopic viewing system having a view area fixed with respect to the point of regard of the launch tube and having an image plane wherein a field of view appears;

a reticle movable in the image plane for visually displaying an indication to an operator; and a reticle control means responsive to the electrical missle tracking head signal for moving the reticle within the image plane in accordance with the missile's point of regard indicated by the electrical missile tracking head signal, wherein the grip-stock is plugged-connectable into the lauch tube for communication between the grip-stock and the electronic control anmd guidance system; and wherein said adapter means includes a plug connection means plug-connectable to the grip-stock and plug-connectable to the launch tube for interposing the grip-stock and launch tube.

2. A missile aiming sight according to claim 1 wherein the reticle control means includes an elevation sensor means for generating super-elevation signal to compensate for gravity induced drop; and wherein the electronic control and guidance system is responsive to the super-elevation signal; and wherein the indication visually displayed by the reticle is a lead position with respect to the point of regard of the missile.

3. A missile aiming sight according to claim 1 wherein the electronic control and guidance system searches for and locks onto a heat source of a particular heat magnitude and generated a second electrical signal indicative of a lock-on of a heat source; and wherein the missile aiming sight includes a lock-on indicator means responsive to the second electrical signal generated by the electronic control and guidance system, for alerting an operator that lock-on of a heat source has occurred.

4. A missile aiming sight according to claim 1 wherein said reticle control means includes a lead control means for monitoring the movement of the launch tube and generating a missile lead signal indicative of a lead position of the launch tube relative to the point of regard of the missile; and wherein said reticle control means is responsive to said missile lead signal and wherein said indication visually displayed by said reticle is a lead position with respect to the point of regard of the missile.

5. A missile aiming sight according to claim 1 and further including a fire inhibit means for monitoring the point of regard of the missile relative to said view area of said telescopic viewing system for inhibiting missile launch.

6. A missile aiming sight according to claim 5 and further including a warning indicator means responsive to said fire inhibit means for signaling an operator that missile launch is being inhibited.

7. A missile aiming sigh according to claim 6 wherein said warning indicator means includes a visual indicator in said image plane of said telescopic viewing system.

8. A missile aiming sight according to claim 7 herein said visual indicator is located at the center of said view area.

9. A missile aiming sight according to claim 8 wherein said visual indicator includes a plurality of visual elements located at the center and at the periphery of said view area.

10. A missile aiming sight according to claim 8 wherein said visual indicator is a light emitting diode.

11. A missile aiming sight according to claim 10 wherein said fire inhibit means generates an electrical inhibit signal, and wherein said light emitting diode repetitively flashes ON and OFF.

12. A missile aiming sight according to claim 5 wherein said fire inhibit means generates an electrical inhibit signal; and wherein said adaptor means includes means for physically preventing the trigger means from being actuated to launch the missile.

13. A missile aiming sight according to claim 12 wherein the trigger means includes a trigger manually moveable to a physical position for launching the missile; and wherein said means for physically preventing the trigger means from being actuated prevents the trigger from being moved to the physical position whereby the electrical firing of the missile is inhibited.

14. A missile aiming sight according to claim 3 wherein said lock-on indicator means includes a visual indicator in said image plane of said telescopic viewing system.

15. A missile aiming sight according to claim 14 wherein said visual indicator is located at the center of said view area.

16. A missile aiming sight according to claim 15 wherein said visual indicator is a light emitting diode.

17. A missile aiming sight according to claim 1 wherein said reticle control means includes a pattern generator means manually actuable by an operator for generating a pattern electrical signal, said reticle control means moving said reticle in a pre-determined pattern within said image plane in response to said pattern electrical signal generated by said pattern generator means.

18. A missile aiming sight according to claim 1 and further including visual stadia indicators means located in said image plane for visual determination of target in-range condition.

* * * * *

UNITED STATES PATENT AND TRADEMARK OFFICE
CERTIFICATE OF CORRECTION

PATENT NO. : 4,777,861

DATED : October 18, 1988

INVENTOR(S) : John Lecuyer, et al.

It is certified that error appears in the above-identified patent and that said Letters Patent is hereby corrected as shown below:

In Claim 1:

At column 7, line 66, add -- , -- after "target";

At column 8, line 3, add --sight-- after "aiming";

At column 8, line 5, change "minitoring" to --monitoring--;

At column 8, line 21, change "lauch" to --launch--; and

At column 8, line 23, change "anmd" to --and--.

In Claim 2:

At column 8, line 31, add --a-- between "generating" and "super-elevation".

In Claim 3:

At column 8, line 40, change "generated" to --generates--.

Signed and Sealed this

Sixteenth Day of April, 1991

*Attest:*

HARRY F. MANBECK, JR.

*Attesting Officer*

*Commissioner of Patents and Trademarks*